US006783093B2

(12) United States Patent
Limber

(10) Patent No.: US 6,783,093 B2
(45) Date of Patent: Aug. 31, 2004

(54) ORNAMENTAL LIGHTING STRING STORAGE DEVICE

(75) Inventor: Jamie A. Limber, Gilbert, AZ (US)

(73) Assignee: The Christmas Light Co.

( * ) Notice: Subject to any disclaimer, the term of this patent is extended or adjusted under 35 U.S.C. 154(b) by 0 days.

(21) Appl. No.: 10/327,212

(22) Filed: Dec. 20, 2002

(65) Prior Publication Data

US 2004/0118962 A1 Jun. 24, 2004

(51) Int. Cl.[7] ..... B65H 75/40

(52) U.S. Cl. ..... 242/405.2; 242/407; 242/608.2; 242/612; 206/420

(58) Field of Search ..... 242/405.2–405.3, 242/407, 407.1, 608.2, 608.6, 608.7, 604, 612; 206/419, 420, 421, 389; 191/12.4, 12.2 R, 12 R; D8/358, 359

(56) References Cited

U.S. PATENT DOCUMENTS

| | | | | | |
|---|---|---|---|---|---|
| 2,250,281 | A | * | 7/1941 | Sundstrand | 242/405.3 |
| 3,104,076 | A | * | 9/1963 | Wilson | 242/405.3 |
| 3,388,876 | A | * | 6/1968 | Wilson | 242/405.3 |
| 3,838,830 | A | * | 10/1974 | Pettit | 242/405.3 |
| 3,876,073 | A | * | 4/1975 | Herbetko | 242/608.7 |
| 4,442,984 | A | | 4/1984 | Bayat | |
| 4,520,239 | A | | 5/1985 | Schwartz | 191/12.4 |
| 4,557,430 | A | | 12/1985 | Bonhard | |
| 4,721,833 | A | | 1/1988 | Dubay | 191/12.4 |
| 4,917,323 | A | | 4/1990 | Wing | |
| D314,910 | S | | 2/1991 | VanSkiver | D8/359 |
| 5,064,067 | A | | 11/1991 | McAllister et al. | 206/420 |
| 5,168,999 | A | | 12/1992 | Lee et al. | 206/420 |
| D334,334 | S | | 3/1993 | Jarry | D8/359 |
| D334,882 | S | | 4/1993 | Bunch | D8/359 |
| D339,976 | S | | 10/1993 | Ferguson, Sr. | D8/359 |
| 5,287,965 | A | | 2/1994 | Miller | 206/396 |
| 5,381,899 | A | | 1/1995 | Rabbitt | 206/397 |
| 6,585,182 | B1 | * | 7/2003 | Garcia | 242/405.3 |

* cited by examiner

*Primary Examiner*—John M. Jillions
(74) *Attorney, Agent, or Firm*—The Halvorson Law Firm

(57) ABSTRACT

Described is a reel that comprises a single side element that, when attached to a second identical side element, forms a complete reel structure. The side element comprises a ring. The preferably form of the ring comprises an inner ring attached to an outer ring by at least two, preferably eight spanning supports. There is an inner perimeter of the ring that has at least two, preferably four attachment apertures located nearby. There is a handle attached to the ring by two legs to an inner perimeter of the ring. The handle has a top side and a bottom side. Located in the center of the handle is an aperture that, when a rigid objected is inserted into the aperture, allows easy and convenient rotation of the reel thereby facilitating easy wrapping and unwrapping of the linear object.

4 Claims, 6 Drawing Sheets

ORNAMENTAL LIGHTING STRING STORAGE DEVICE

FIELD OF THE INVENTION

The present invention relates to the field of ornamental light strings. More specifically, the present invention is a storage device useful for the storing of ornamental light strings and the like.

BACKGROUND

Every year, many people perform the tedious task of untangling strings of Christmas lights and, once the season is over, attempting to roll or package the strings so they will untangle easily and keep the fragile bulbs from breaking. Variations upon these devices and methods proliferate in the prior art.

For example, U.S. Pat. No. 5,064,067 issued to McCallister, et al., discloses a frame like device that has a plurality of tapered tooth-like projections for wedging the light cord within the formed "V's". This system accommodates only certain sized cords and can accommodate only a limited length of string or strings, which is dependent on the number of formed "V's". Additionally, the device fails to disclose a device that avoids bulb breakage.

Another example is U.S. Pat. No. 5,168,999 issued to Lee, et al., and U.S. Pat. No. 5,381,899 issued to Rabbitt. These patents describe light packaging devices for viewing, testing and eventual retail sale of light strings. The specification in Lee, et al., indicates the device is primarily for storage of lights, however the repackaging of Christmas lights in the device appears to be time consuming. In addition, the devices are designed to hold only a single string of lights.

U.S. Pat. No. 5,287,965, issued to Miller, discloses a cardboard core around which Christmas lights are wrapped. This device does not have a notch for holding the beginning or end of the string and is designed for only a single light string.

U.S. Pat. No. Design 339,976 issued to Ferguson, Sr., discloses a combined reel and cover with a crank for storage of Christmas light strings.

U.S. Pat. No. 4,917,323 issued to Wing, discloses a cylindrical device having several circular crowns with slits for inserting separate light bulbs of a Christmas light string.

U.S. Pat. No. 4,721,833 issued to Dubay discloses a retrievable electric cord reel. U.S. Pat. No. Des. 314,910 issued to VanSkiver discloses a cord storage reel. U.S. Pat. No. Des. 334,882 issued to Bunch discloses a combined electric cord reel and dispenser. U.S. Pat. No. Des. 334,334 issued to Jarry discloses an extension cord reel. U.S. Pat. No. 4,520,239 issued to Schwartz discloses an electrical cord reel and storage system. U.S. Pat. No. 4,557,430 issued to Bonhard discloses a power cord storage and dispenser. U.S. Pat. No. 4,442,984 issued to Bayat discloses an electric cord reel.

While these devices fulfill their respective, particular objective and requirements, the aforementioned patents do not describe a light string storage reel for storing strings of lights and light accessories in a neat and organized fashion.

In this respect, the light string storage reel according to the present invention substantially departs from the conventional concepts and designs of the prior art, and in doing so provides an apparatus primarily developed for the purpose of storing strings of lights and light accessories in a neat and organized fashion.

Therefore, it can be appreciated that there exists a continuing need for new and improved light string storage reel which can be used for storing strings of lights and light accessories in a neat and organized fashion. In this regard, the present invention substantially fulfills this need.

SUMMARY OF THE INVENTION

It is an object of the present invention to provide a reel that comprises two identical side structures attached to each other, each of said identical side structure comprising a ring having a handle attached to an inner perimeter by two legs, the handle including a central aperture and a series of concave/convex shapes alone one side of the handle to provide a conforming structure to a user's hand, a projecting attachment tang and an attachment tang receiving aperture, the attachment tang and attachment tang receiving aperture located on the handle such that when two side elements are brought together, the attachment tang on one side element mates with, and is received by a matching attachment tang receiving aperture located on the handle of the second side element.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
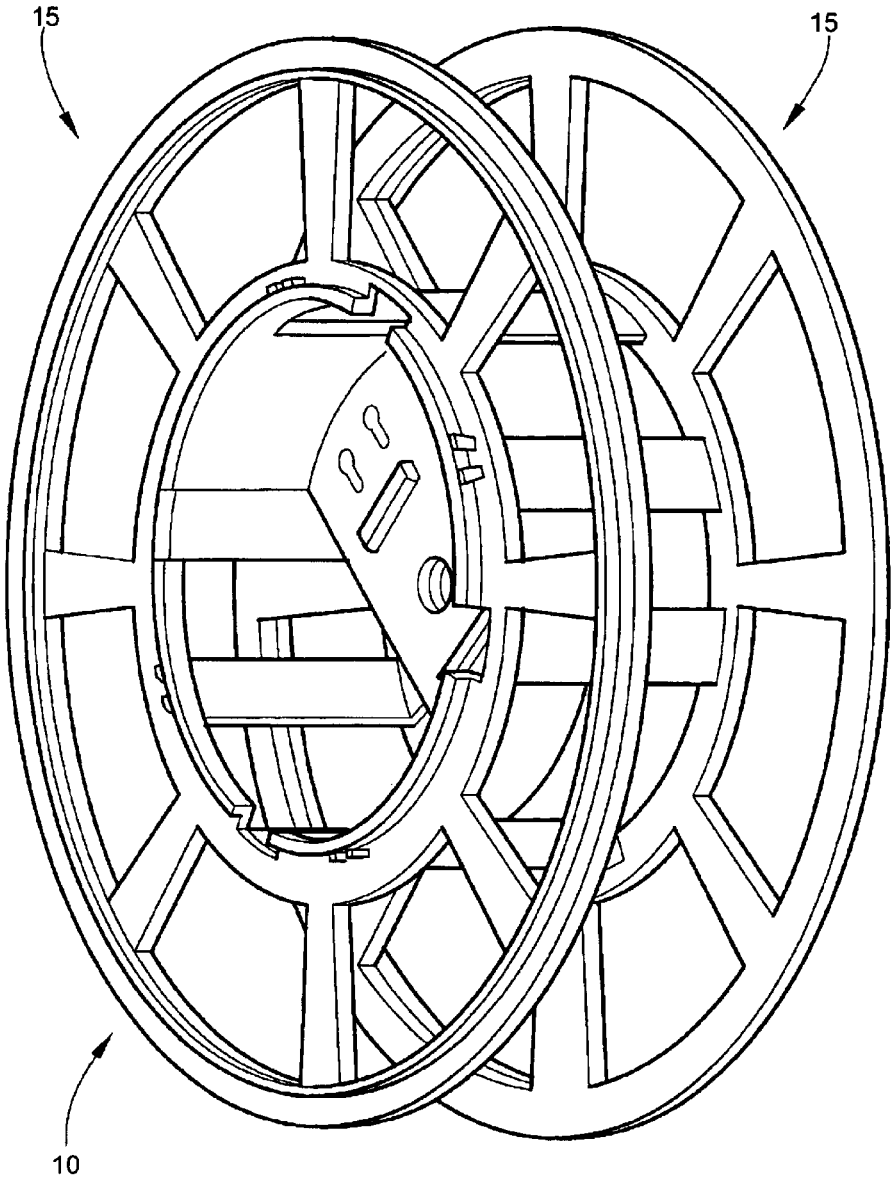
FIG. 1 is a perspective view of the reel according to the present invention.
Figure 2:
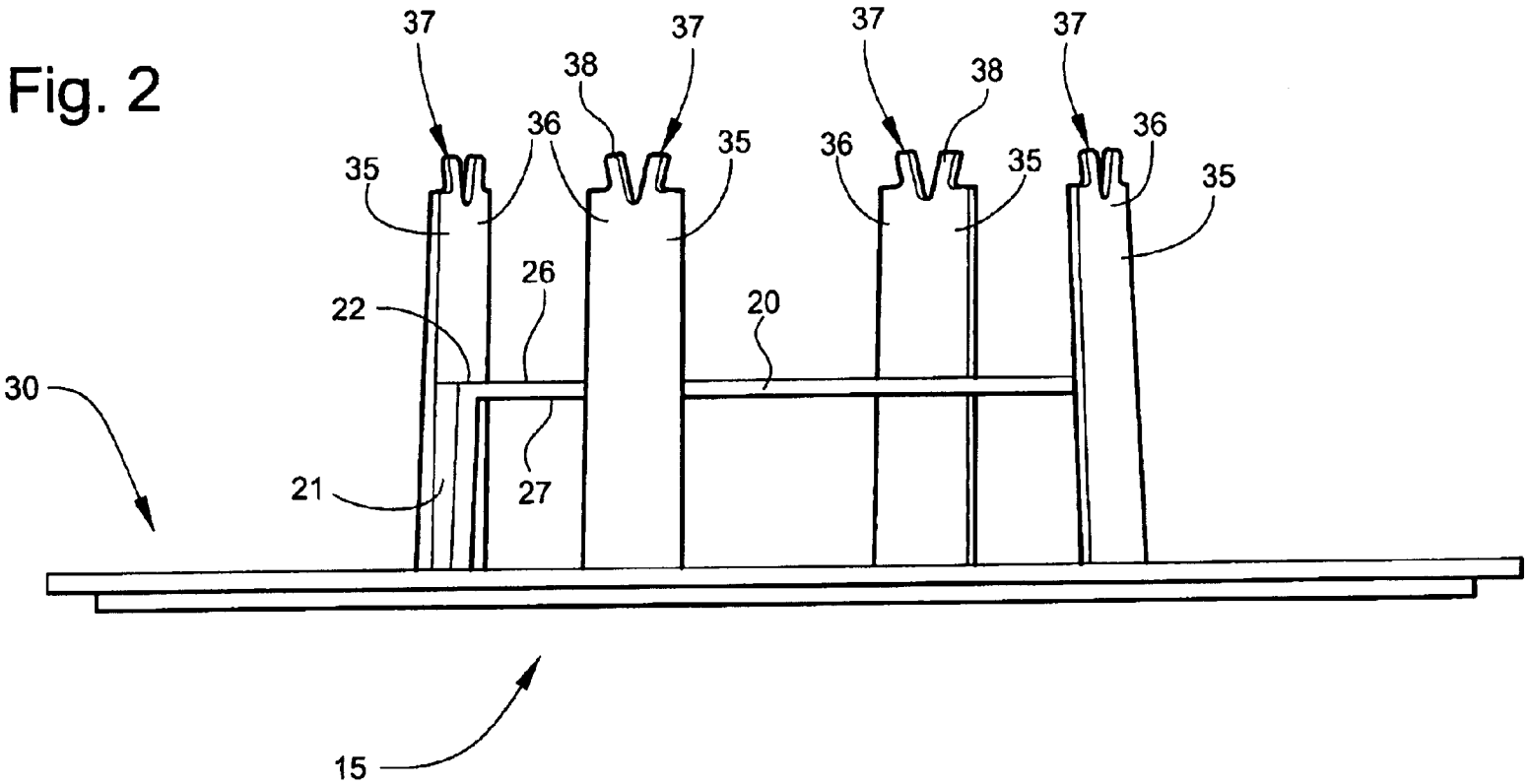
FIG. 2 is a side view of one element of the reel according to the present invention.
Figure 3:
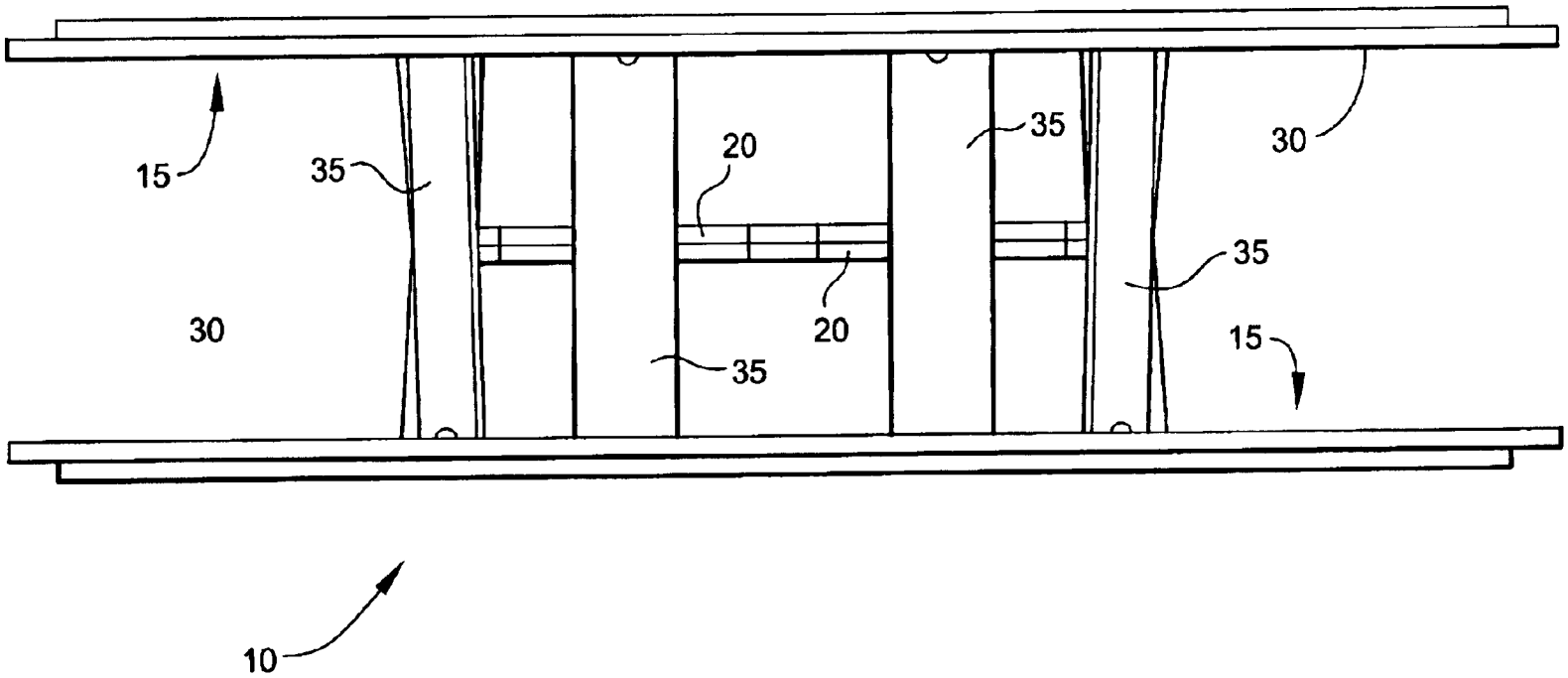
FIG. 3 is a side view of two elements together, forming a complete reel according to the present invention.
Figure 4:
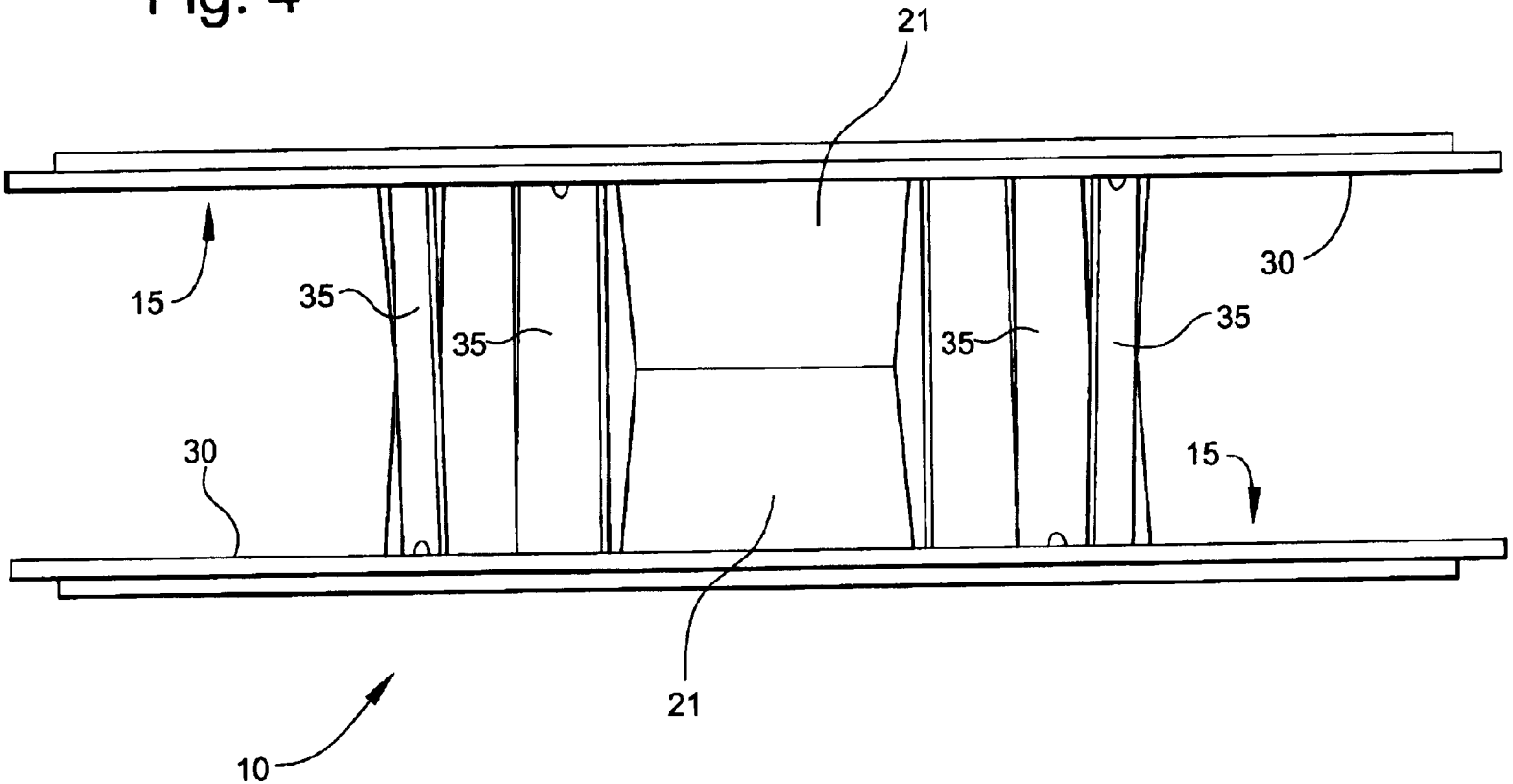
FIG. 4 a second side view of two elements together, forming a complete reel according to the present invention, said second side view rotated 90° relative to the first side view.
Figure 5:
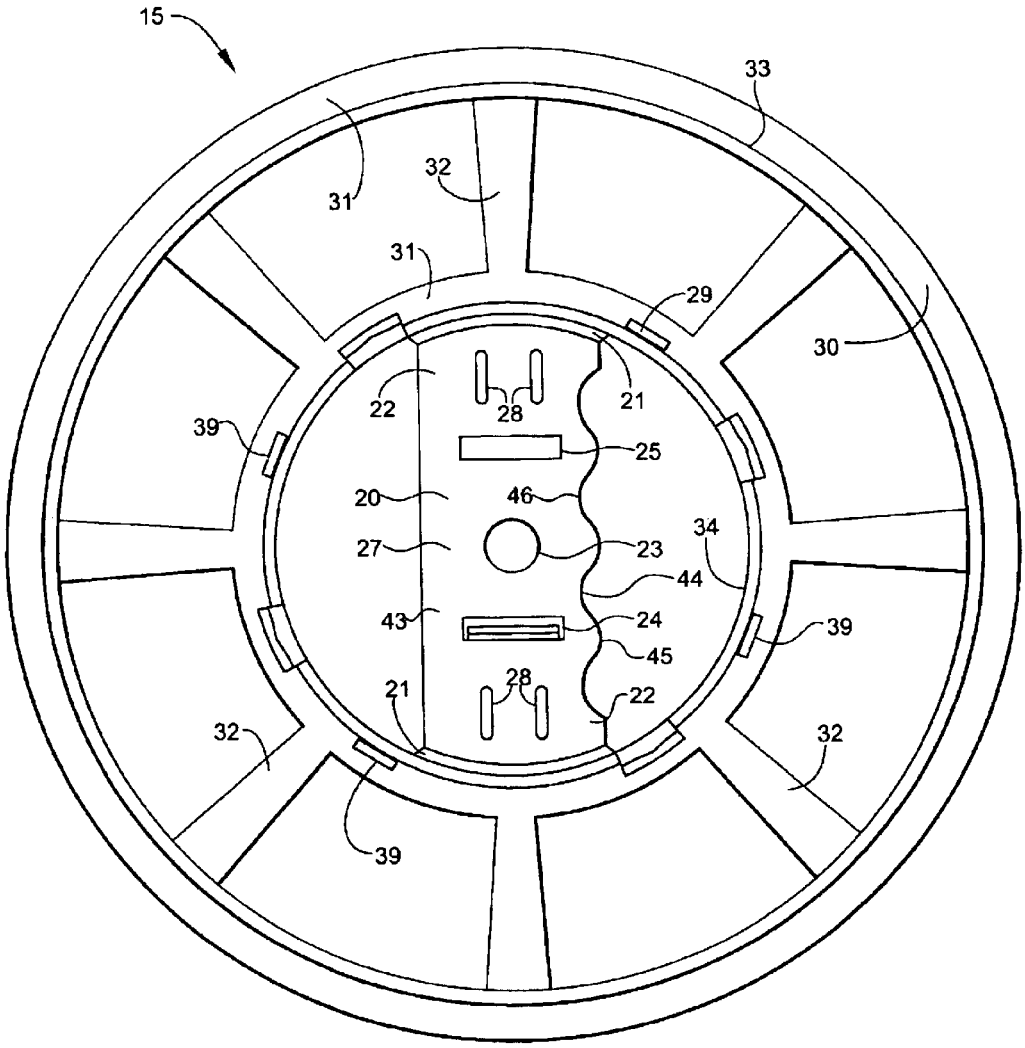
FIG. 5 is an end view of the reel according to the present invention.
Figure 6:
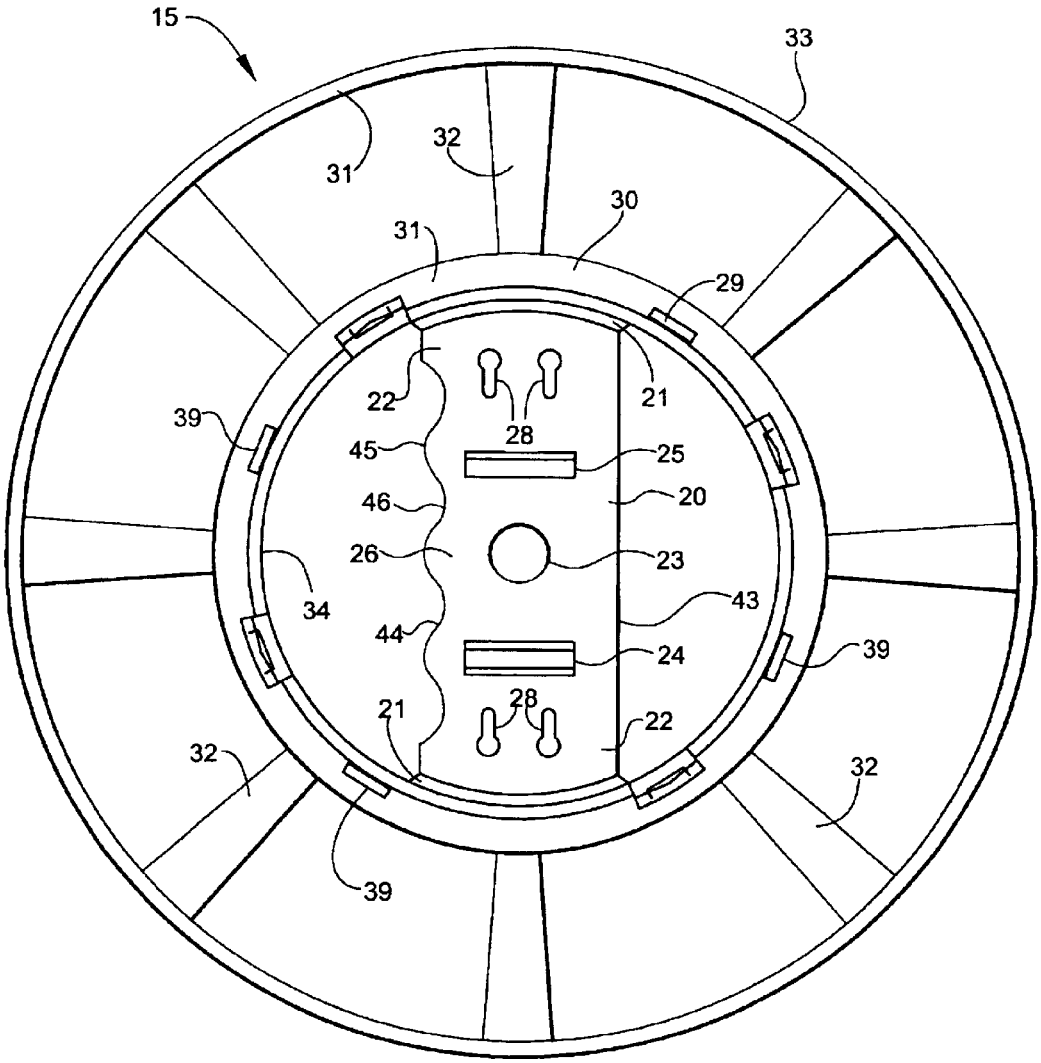
FIG. 6 is a second end view of the reel according to the present invention.

The present invention is a reel 10 for wrapping and flexible linear objects, such as electrical extension cords, ornamental light strings and the like.

The reel 10 according to the present invention comprises a single side element 15 that, when attached to a second identical side element, forms a complete reel structure.

The side element 15 comprises a ring 30. The preferably form of the ring 30 comprises an inner ring 31 attached to an outer ring 33 by at least two, preferably eight spanning supports 32. There is an inner perimeter 34 of the ring 30 that has at least two, preferably four attachment apertures 39 located nearby.

There is a handle 20 attached to the ring 30 by two legs 21 to an inner perimeter of the ring 30. The handle 20 has a top side 26 and a bottom side 27. Located in the center of the handle 20 is an aperture 23 that, when a rigid objected is inserted into the aperture 23, allows easy and convenient rotation of the reel 30 thereby facilitating easy wrapping and unwrapping of the linear object. Additionally there are at least one, preferably two, pairs of slits 28, each pair of which is located near a leg 21. The pair of slits 28 are supplied to receive and store male ends of electrical cords or light strings. Alternately, the slits of the pair of slits 28 may have a key-hole outline. Located along one side 44 of the handle 20 are a series of concave/convex shapes 45/46 that are provided to conform with a user's fingers, thereby providing easy and comfortable gripping of the handle 20 across sides 43 and 44.

There are at least two, preferably four, perpendicular attachment supports 35. The number of perpendicular attachment supports 35 should match the number of attachment apertures 39 located near the inner perimeter 34 of the ring 30. Each attachment support 35 has two tangs, 37 and 38, attached at a distal end of the attachment support 35.

The handle 20 further comprises a projecting attachment tang 24 and attachment tang receiving aperture 25. The attachment tang 24 and attachment tang receiving aperture 25 are located on the handle 20 such that when two side elements 15 are brought together, the attachment tang 24 on one side element 15 mates with, and is received by a matching attachment tang receiving aperture 25 located on the handle 20 of the second side element 15

In assembly, two side elements 15 are brought together such that the attachment tang 24 of one side element 15 mates and is inserted into the attachment tang receiving aperture 25 of the second side element 15. The two tangs 37 and 38 should also be mated and inserted into matching attachment apertures 39 located on the inner perimeter of the ring 30. A linear object, such as an electrical extension cord or ornamental light string may then be easily wrapped around the resulting complete reel 10. For easy unwrapping, a rigid object may be inserted into the aperture 23 and the linear object is pulled, allowing the reel 10 to rotate about the rigid object. It has been found that, for certain ornamental light strings, gravity is sufficient to unwind the ornamental light string, thereby requiring very little effort by the user.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A reel that comprises two identical side structures attached to each other, each of said identical side structure comprising: a ring having a handle attached to an inner perimeter by two legs, the handle including a central aperture and a series of concave/convex shapes alone one side of the handle to provide a conforming structure to a user's hand, a projecting attachment tang and an attachment tang receiving aperture, the attachment tang and attachment tang receiving aperture located on the handle such that when two side elements are brought together, the attachment tang on one side element mates with, and is received by a matching attachment tang receiving aperture located on the handle of the second side element.

2. The side element of the reel according to claim 1 wherein the ring is a pair of co-planar rings attached to each other by at least two spanning supports.

3. The side element of the reel according to claim 1 further comprising at least two perpendicular attachment supports located near the inner perimeter of the ring, each attachment support further having two tangs attached at a distal end of the attachment support and a matching number of receiving apertures also located along the inner perimeter of the ring, said receiving apertures located such that when two side elements are brought together the receiving apertures on one side element matches the perpendicular attachment supports located on the other side element.

4. The side element of the reel according to claim 2 further comprising at least two perpendicular attachment supports located near the inner perimeter of the ring, each attachment support further having two tangs attached at a distal end of the attachment support and a matching number of receiving apertures also located along the inner perimeter of the ring, said receiving apertures located such that when two side elements are brought together the receiving apertures on one side element matches the perpendicular attachment supports located on the other side element.

* * * * *